United States Patent [19]

Uy

[11] 4,086,949

[45] May 2, 1978

[54] FILAMENTS COATED WITH A FATIGUE REDUCING FINISH COMPRISING A POLY(VINYL ALKYL ETHER) USED AS REINFORCEMENTS IN RUBBER ARTICLES

[75] Inventor: William Cheng Uy, Wilmington, Del.

[73] Assignee: E. I. Du Pont de Nemours and Company, Wilmington, Del.

[21] Appl. No.: 772,299

[22] Filed: Feb. 25, 1977

[51] Int. Cl.[2] ..... B29H 9/02; B29H 9/04; B32B 25/02; B32B 31/12; B60C 1/00

[52] U.S. Cl. ..... 152/359; 156/110 A; 156/110 C; 428/392; 428/395

[58] Field of Search ..... 152/359; 428/392, 395; 156/110 A, 110 C; 28/75 R

[56] References Cited

U.S. PATENT DOCUMENTS

| | | | |
|---|---|---|---|
| 2,888,365 | 5/1959 | Corkum | 428/392 |
| 3,113,369 | 12/1963 | Barrett et al. | 28/75 R |
| 3,630,259 | 12/1971 | Brignac | 152/359 |
| 3,946,132 | 3/1976 | Hedden | 428/392 |

FOREIGN PATENT DOCUMENTS

| | | | |
|---|---|---|---|
| 1,338,732 | 11/1973 | United Kingdom | 428/395 |

*Primary Examiner*—J.C. Cannon

[57] ABSTRACT

A lubricating finish composition for filaments, yarns and cords used as reinforcement in rubber articles is comprised of a lubricant oil, a solid lubricant, poly(vinyl alkyl ether) and an emulsifier. A desirable combination of good adhesion and fatigue resistance is provided in reinforced rubber articles.

19 Claims, No Drawings

FILAMENTS COATED WITH A FATIGUE REDUCING FINISH COMPRISING A POLY(VINYL ALKYL ETHER) USED AS REINFORCEMENTS IN RUBBER ARTICLES

BACKGROUND OF THE INVENTION

This invention relates to yarns and cords composed of synthetic filaments having a lubricating finish composition on their surfaces. More particularly, it concerns filaments coated with a finish which are particularly useful for industrial yarns and cords used as reinforcement in rubber articles.

Vehicle tires are subjected to stresses and flexes which cause gradual physical breakdown in filaments of reinforcing cords, a phenomenon called "fatigue". Resistance to fatigue can be improved by applying a lubricating finish to the filaments, but it is quite difficult to find a satisfactory finish which does not cause a serious lowering of cord-to-elastomer adhesion. Finish compositions containing a wide variety of oils and added materials have been tried in attempts to obtain adequate adhesion with improved resistance to fatigue.

Several processing characteristics are desirable for a satisfactory lubricating finish composition. It should be one which is readily prepared and is stable on standing, without phase-separation in layers. It should be easily applied to form a uniform coating on the filaments, so a reasonably low viscosity without use of volatile components is desirable to avoid having to dry the applied coating. It should not form appreciable deposits on hot rolls used in after-treatments, since a rapid rate of deposit formation would cause unacceptable process interruptions. It should not fume objectionably on hot rolls used in after-treatments. It should not have a deleterious effect on the normal physical properties of cords prepared for use in tires and other reinforced articles.

SUMMARY OF THE INVENTION

The present invention includes synthetic filaments, yarns and cords having the surfaces of the filaments coated with a lubricating finish composition which has satisfactory processing characteristics and provides a desirable combination of rubber-adhesion and fatigue resistance properties when the cords are used as reinforcement in tires.

The present invention provides a synthetic filament coated with 0.4 to 2% by weight of a lubricating finish composition comprising (1) 60–96% by weight of a lubricant oil, (2) 1–6% by weight of a solid lubricant selected from the group consisting of metallic soaps, graphite, boron nitride, fumed silica, polyalkylene waxes and microcrystalline waxes, (3) 1–15% by weight of a poly(vinyl alkyl ether) having 1–4 carbon atoms in the alkyl group and (4) 0–30% by weight of an emulsifier. The finish composition may optionally contain an antioxidant such as 1,1-butylidene-4,4'-bis(2-t-butyl-5-methylphenol) or 4,4'-thiobis(2-t-butyl-5-methylphenol). Preferably the lubricant oil is selected from the group consisting of a phthalic acid ester of an alkanol having 8–14 carbon atoms and pentaerythritol completely esterified with a fatty acid or a mixture of fatty acids having 8–10 carbon atoms. Preferably, the poly(vinyl alkyl ether) is poly(vinyl methyl ether) having a weight average molecular weight of 10,000–70,000. If the molecular weight of the poly(vinyl alkyl ether) is in the low end of this molecular weight range, relatively larger amounts of the polyether should be used. If the molecular weight of the poly(vinyl alkyl ether) is in the high end of the molecular weight range, relatively smaller amounts of polyether should be used. When the weight average molecular weight of the polyether is 18,000, finish compositions containing 4–10% by weight poly(vinyl methyl ether) (e.g. Gantrez MO93) are suitable. If the weight average molecular weight of the polyether is 62,000, finish compositions containing 2–6% by weight of poly(vinyl methyl ether) (e.g. Lutonal M40) are suitable. Most preferably, the lubricant oil is selected from the group consisting of diundecyl phthalate and pentaerythritol tetrapelargonate. It is highly preferred that the solid lubricant be a metallic soap such as magnesium stearate or lithium stearate. Solid lubricants selected from the group consisting of polyalkylene and microcrystalline waxes are also preferred. Most preferably the filaments are coated with 0.4 to 2% by weight of a lubricating finish composition comprising (1) 60–96% by weight of a lubricant oil selected from the group consisting of diundecyl phthalate and pentaerythritol tetrapelargonate, (2) 1–6% by weight of a solid lubricant selected from the group consisting of magnesium stearate, lithium stearate, polyalkylene waxes and microcrystalline waxes, (3) 1–15% by weight of poly(vinyl methyl ether) having a weight average molecular weight of 10,000–70,000 and (4) 2–30% by weight of an emulsifier.

The lubricant oil serves as the carrier while the solid lubricant provides abrasion resistance to the yarn. Inclusion of the poly(vinyl alkyl ether) in the finish composition greatly improves the fatigue reducing properties of the finish. Addition of an emulsifier further improves the finish by suppressing the tendency for deposits to form on guide surfaces, a problem that is intensified with the addition of poly(vinyl alkyl ether). Known emulsifiers, such as those based on fatty acids can be used and comprise 2–30% by weight of the finish composition. The preferred emulsifier is the reaction product of one mole sorbitol, 40 moles ethylene oxide and 7 moles oleic acid, used in amounts of 2–8%, preferably about 4% by weight. Another useful emulsifier is a coconut oil fatty acid diethanolamide. Antioxidants, if used, may be present in amounts of 0.5–3% by weight.

The finish is applied to the yarns or cords at any stage in processing and is applied in amounts of about 0.4–2% by weight, preferably 0.7–1.3% by weight based on the weight of the yarn or cord. Any of the known synthetic filaments can be coated according to the present invention. The finish composition can be applied to polyamides or polyesters and is especially useful for aromatic polyamides such as poly(p-phenylene terephthalamide).

The finish composition is conveniently prepared by adding the lubricant oil to the poly(vinyl alkyl ether) and heating, preferably to about 60°–90° C with stirring. The mixture is kept at this temperature until the poly(vinyl alkyl ether) is dissolved. Then the mixture is cooled below 75° C and the solid lubricant is added and dispersed, and in the case of solid lubricants which can be dissolved, the mixture is heated to about 90°–120° C and kept there until the solid lubricant is dissolved. Otherwise the solid lubricant is dispersed at the temperature at which the poly(vinyl alkyl ether) is in solution. The emulsifier and antioxidant, if used, are added at any convenient time. The mixture is quenched rapidly to room temperature with moderately vigorous stirring to form the final dispersion.

TESTS

Disc Fatigue

The yarns or cords containing the finish are tested for fatigue resistance by the disc fatigue test described in "Tyre Cord Fatigue", by J. Zimmerman, *Textile Manufacturer,* 101(49), February, 1974. See also, U.S. Pat. No. 2,595,069. In this test, three cords having a length of 2–3 feet are embedded and cured in rubber blocks. The blocks are 3 inches long in the direction of the cord length and 0.5 inches square in the direction transverse to the cord length. The blocks are mounted into the periphery of two circular discs, so that a 1 inch section is subjected to testing. The elongation and compression of the samples are controlled by canting the discs relative to each other and by adjusting the distance between the discs, respectively. Thus when the discs revolve, the rubber blocks containing the cords are alternately compressed and extended to extents which are separately controlled. The usual running time is 11.5 hours at 2700 rpm. Generally, there is no significant further loss in strength after 11.5 hours. The rubber blocks are softened in perchloroethylene and the cords are removed. The tensile strength of the removed cords is determined and compared with the tensile strength of cords which were cured into blocks of rubber but not fatigued.

Disc fatigue tests run at settings of 15% extension/2% compression (15E/2C) approximately simulate the conditions encountered by a 1500/1/2 (yarn denier/no. yarns twisted/no. plies twisted), 8 twist multiplier (TM) aromatic polyamide tire cord prepared at a tension of 0.2 gpd during use in tires on cars, trucks and off-road vehicles. For cords of different construction prepared under different tensions, different disc settings will be required, as illustrated in the examples. The finish of the present invention which performed well in a disc fatigue test appropriate for the cord construction also performed well in tests in actual tires, whereas other finishes which performed poorly in this test also performed poorly in tires.

Tensile Properties

Tensile properties are determined on a conventional Instron tensile tester according to ASTM D 885–76 using a breaking length of 10 inches and a 50%/minute strain rate.

Wheel Flex

The wheel flex test is described in J. W. Hannell, "Tire Testing", *Journal of Eng. for Industry,* Vol. 82, Series B, No. 1, Feb. 1960, p. 23).

In the wheel flex test, the tire is run at 35 mph on a 67.23-in. dia. wheel in a room controlled at 100° F. (The circumference — 1/300th of a mile — and 100° F are standard conditions usually used in wheel testing.) A break-in period provides for relieving internal stress by running the tire at progressively lower pressures and increasing deflection between rim and test-wheel surface. The break-in period is usually 2 hrs at 18 psi, 1 hr at 16 psi, and 1 hr at 14 psi with loads sufficient to give 24% static deflection. Finally, the tire is run for 3,000 miles at 35 mph with a load sufficient to produce a 21% dynamic tire deflection at 18 psi. The strength loss between the cord removed from an inner ply of a fatigued sample and a cord removed from an untested control is used as a measure of fatigue performance.

High Load Wheel Test for Bias Truck Tires

The wheel test for bias truck tires is run at 22 mph under high pressure and high load conditions for 2,000 miles. The strength loss in cord removed from the outer plies is used as a measure of fatigue performance. In Example 15, 10.00–20 size tires with tubes were made using 4 plies of 16 cord ends/inch in each ply. The test load selection was 7200 lbs at 85 psi. The break-in prior to testing was 6 hrs. at a 4,000 lb. load and 6 hrs. at a 5400-lb. load.

Cornering Flex Test

In the cornering flex test, the tire is mounted with a +3° camber (inclination angle to the wheel test surface) and with a 6° left slip (angle in the direction of travel). The tire, which is inflated to 24 psi and loaded to 125% of the TRA load, is run to failure, recording the time to failure. The Tire and Rim Association (TRA) load is that designated load for a given size tire and inflation pressure and can be found in the Tire and Rim Association Year Book (1976).

The invention is illustrated by the following examples:

EXAMPLES 1–13

Finish compositions are prepared according to the general procedure described above. The finish composition ingredients are listed as percentages by weight in Table I, the remainder of the composition being diundecyl phthalate. The filaments coated were poly(p-phenylene terephthalamide filaments having a yarn tenacity/elongation/initial modulus/denier of 20/4/500/1500 prepared according to U.S. Pat. No. 3,767,756. Cords were prepared as indicated in Table I and subjected to the disc fatigue test. The results are shown in Table I.

TABLE I

| Example | Finish Composition | Finish on Yarn % by wt. | Cord Construction** | Disc Fatigue Strength Loss at Setting (vs. control*) |
|---|---|---|---|---|
| 1 | 8% PVME (Gantrez MO93)[a]<br>2% Magnesium Stearate | 1.0 | 1500/1/2<br>8 TM<br>low stretching tension<br>(0.2 gpd) | 4% at 15E/2C<br>(21%) |
| 2a | 0% PVME (Gantrez MO93)<br>3% Magnesium Stearate<br>0.5% 2,2'-thiobis(4-methyl-6-t-butylphenol)<br>1.5% hexamethylphosphoramide/N-methylpyrrolidone-2(2/1)<br>containing 3% lithium chloride | 0.9 | 6.5 TM<br>high stretching tension<br>(1.0 gpd then 0.3 gpd)<br>(adhesive dip/latex dip)<br>1500/1/2 | 17% at 6E/2c<br>(34%) |
| 2b | 0% PVME (Gantrez MO93)<br>2% Magnesium Stearate<br>0.5% 2,2'-thiobis(4-methyl-6-t-butylphenol)<br>1.5% hexamethylphosphoramide/N- | 0.9 | " | 34% at 6E/2c<br>(33%) |

TABLE I-continued

| Example | Finish Composition | Finish on Yarn % by wt. | Cord Construction** | Disc Fatigue Strength Loss at Setting (vs. control*) |
|---|---|---|---|---|
| | methylpyrrolidone-2(2/1) containing 3% lithium chloride | | | |
| 3a | 3% PVME (Gantrez MO93) 0% Magnesium Stearate 0.5% 2,2'-thiobis(4-methyl-6-t-butylphenol) 1.5% hexamethylphosphoramide/N-methylpyrrolidone-2(2/1) containing 3% lithium chloride | 0.9 | " | 24% at 6E/2c (32%) |
| 3b | 8% PVME (Gantrez MO93) 0% Magnesium Stearate | 1.2 | 1500/1/2 8 TM low stretching tension (0.2 gpd) | 9% at 15E/2c (19%) |
| 4a | 4% PVME (Gantrez MO94)[d] 0% Magnesium Stearate | 1.0 | " | 4% at 15E/2c (16%) |
| 4b | 8% PVME (Gantrez MO94)[d] 0% Magnesium Stearate | 1.0 | " | 11% at 15E/2c (16%) |
| 5a | 2% PVME (Lutonal M40)[b] 2% Magnesium Stearate | 1.0 | " | 13% at 15E/2c (37%) |
| 5b | 4% PVME (Lutonal M40) 2% Magnesium Stearate | 1.0 | " | 5% at 15E/2c (37%) |
| 5c | 6% PVME (Lutonal M40) 2% Magnesium Stearate | 1.0 | " | 13% at 15E/2c (37%) |
| 5d | 8% PVME (Lutonal M40) 2% Magnesium Stearate | 1.0 | " | 4% at 15E/2c (37%) |
| 6a | 8% PVME (Gantrez MO93) 2% Magnesium Stearate | 1.1 | 1500 1/2 8 TM low stretching tension (0.2 gpd) | 5% at 15E/2c (15%) |
| 6b | 8% PVME (Gantrez MO93) 2% Magnesium Stearate 4% G-1087[c] 0.5% 1,1-butylidene-4,4'-bis(2-t-butyl-5-meethylphenol) | 1.1 | " | 7% at 15E/2c (15%) |
| 7 | 8% PVME (Gantrez MO93) 2% Epolene, E10 (oxidized polyethylene microcrystalline wax) | 0.9 | " | 7% at 15E/2c (21%) |
| 8 | 8% PVME (Gantrez MO93) 2% Lithium Stearate | 1.0 | " | 3% at 15E/2c (23%) |
| 9 | 8% PVME (Gantrez MO93 2% Graphite | 1.0 | " | 13% at 15E/2c (23%) |
| 10 | 8% PVME (Gantrez MO93) 2% Boron Nitride | 1.1 | " | 8% at 15E/2c (23%) |
| 11 | 8% PVME (Gantrez MO93 2% Fumed Silica | 1.0 | " | 11% at 15E/2c (21%) |
| 12 | 8% PVME (Gantrez MO93) 2% Magnesium Stearate | 0.7 overlay on 0.35 control | 1260/1/2 Nylon 66 6.2 TM | 7% at 18E/4c 115° C, 24 hr. (16%) |
| 13 | 8% PVME (Gantrez MO93) 2% Magnesium Stearate | 1.1 overlay on 0.65 control*** | poly(ethylene terephthalate) 1000/1/3 6.8 TM | 16% at 7.2E/11.7c (27%) 1.6% by wt. of the finish of U.S.P. 3,387,996 |

*filaments coated with 1% by weight of a conventional finish based on coconut oil unless otherwise stated
**cord construction = yarn denier/yarns twisted/plies twisted, tension in adhesive dip/latex dip
***filaments coated with a conventional polyester finish (U.S. Pat. No. 3,387,996)
[a]Product of General Aniline and Film Corp. (GAF) $\bar{M}w$ = 18,000 estimated
[b]Product of Badische Aniline und Soda Fabrik (BASF) $\bar{M}w$ = 62,000 estimated
[c]Reaction product of 1 mole Sorbitol, 40 moles ethylene oxide and 7 moles oleic acid
[d]Product of General Aniline and Film Corp. (GAF) estimated $\bar{M}w$ = 40,000–60,000
PVME = poly(vinyl methyl ether)

$$\text{TM} = \text{twist multiplier} = \frac{\text{turns per inch}\sqrt{\text{cord denier}}}{72.9}$$

EXAMPLE 14

An 800 denier balanced cord of poly(p-phenylene terephthalamide) filaments is prepared from twisted single yarns two plied, (400/1/2), using a twist multiplier (TM) of 7.7 and a tension of 1 gpd./0.3 gpd. (adhesive dip/latex dip). The filaments are coated with 1% by weight of a finish consisting of 90 parts diundecyl phthalate, 8 parts poly(vinyl methyl ether) (PVME) (Gantrez MO93, 18,000 Mw) and 2 parts magnesium stearate. The cord is used to prepare underconstructed 7.75–14, 2 ply, 60 ends/inch (EPI) tires. The tires along with tires made from a similar cord from an identical yarn coated with 1% by weight of a conventional finish based on coconut oil is subjected to the wheel flex test. The tires containing the yarn of the invention (3 tires tested) did not fail in 3000 miles. All three of the control tires made from yarn coated with the conventional finish failed within 2163 miles. Cords were removed from the tires after swelling in perchloroethylene and tested for strength loss. The cords prepared from filaments coated according to the present invention showed a strength loss of 29% vs. 50% for cords prepared from filaments coated with the conventional finish based on coconut oil. The original cords were also subjected to the disc fatigue test at 6E/2C. The cord containing the filaments of the invention suffered a strength loss of 35% as compared to a strength loss of 48% for a cord containing filaments coated with the conventional finish based on coconut oil.

EXAMPLE 15

A 1500 denier yarn similar to the yarn of Example 14 is used to prepare under a low tension of 0.1 gpd. a 1500/1/3 cord having a twist multiplier of 8.5. The disc fatigue test (18E/2C) showed a strength loss of 5% as compared to 15% strength loss for a control cord prepared from the same filaments coated with the conventional finish based on coconut oil. 10.00–20, 4 ply, 16 ends/inch bias ply tube type truck tires were prepared from the cord and subjected to the high load truck tire wheel test along with control tires containing cords made from yarns coated with the conventional coconut oil based finish. After 2000 miles, 85 lbs/in.$^2$ pressure and a load of 7200 lbs., there were no failures. Cords were extracted from the outer plies of the test tires after swelling in perchloroethylene. The cords prepared from the yarn of the invention suffered a strength loss of 10% vs. 20% for control cord prepared from yarn coated with the conventional finish.

EXAMPLE 16

A yarn identical to the yarn of Example 15 except the finish consists of 90 parts diundecyl phthalate, 8 parts PVME of 18,000 mol. wt., 2 parts magnesium stearate, 4 parts of the reaction product of 1 mole sorbitol, 40 moles ethylene oxide and 7 moles oleic acid, and 0.5 parts of 1,1-butylidene-4,4'-bis(2-t-butyl-5-methylphenol) is made into a 1500/1/2, 6.5 TM cord. The cord is subjected to the disc fatigue test at 6E/2C along with a control coated with the conventional coconut oil finish. Strength loss of the cord containing the filaments of the invention is 19% as compared to 40% for the control. The cord was used in the belt of FR 78–16, 15 ends/inch tires and, along with similar tires prepared from cords in which the yarn was coated with the conventional finish based on coconut oil, were subjected to the cornering flex test, 6° slip, 3° camber. The tires containing the filaments of the present invention failed after 27 hours testing as compared to 12 hours for the control tires containing filaments coated with the conventional finish.

EXAMPLES 17–19

Finish compositions are prepared according to the general procedure described above. The finish composition ingredients are listed as percentages by weight in Table II. The filaments coated were poly(p-phenylene terephthalamide) filaments having tenacity/elongation-/initial modulus/denier of 20/4/500/1500 prepared according to U.S. Pat. No. 3,767,756. Cords were prepared as indicated in Table II and subjected to the disc fatigue test. The results are summarized in Table II.

TABLE II

| Example | Finish Composition | Finish on Yarn % by wt. | Cord Construction** | Disc Fatigue Strength Loss at Setting (control*) |
|---|---|---|---|---|
| 17a | 80% PETP<br>8% PVME (Gantrez MO93)<br>2% Magnesium Stearate<br>8% PEG-400 dilaurate<br>2% 4,4'-thiobis(2-t-butyl-5-methylphenol) | ~1 | 1500/1/2<br>8 TM<br>low stretch tension<br>(0.2 gpd) | 13% at 15E/2c<br>(15%) |
| 17b | 78% PETP<br>8% PVME (Gantrez MO93)<br>4% Magnesium Stearate<br>8% PEG-400 dilaurate<br>2% 4,4'-thiobis(2-t-butyl-5-methylphenol) | ~1 | " | 8% at 15E/2c<br>(15%) |
| 17c | 76% PETP<br>8% PVME (Gantrez MO93)<br>6% Magnesium Stearate<br>3% PEG-400 dilaurate<br>2% 4,4'-thiobis(2-t-butyl-5-methylphenol) | ~1 | " | 6% at 15E/2c<br>(15%) |
| 18a | 90% PETP<br>8% PVME (Gantrez MO93)<br>2% "Epolene" E-15 (oxidized polyethylene microcrystalline wax) | ~1 | " | 14% at 15E/2c<br>(15%) |
| 18b | 88% PETP<br>8% PVME (Gantrez MO93)<br>4% "Epolene" E-15 (oxidized polyethylene microcrystalline wax) | ~1 | " | 6% at 15E/2c<br>(15%) |
| 18c | 86% PETP<br>8% PVME (Gantrez MO93)<br>6% "Epolene" E-15 (oxidized polyethylene microcrystalline wax) | ~1 | 1500/1/2<br>8 TM<br>low stretch tension<br>(0.2 gpd) | 7% at 15E/2c<br>(15%) |
| 19a | 77.5% PETP<br>4% PVME (Lutonal M40)<br>2% Magnesium Stearate<br>16% Monamid 150 DR<br>0.5% 1,1-butylidene-4,4'-bis-(2-t-butyl-5-methylphenol) | 1.0 | 1500/1/2<br>6.5 TM<br>high stretch tension<br>(1.0 gpd/0.3 gpd) | 28% at 6E/2C<br>(33%) |
| 19b | 79.5% PETP<br>2% PVME (Lutonal M40)<br>2% Magnesium Stearate<br>16% Monamid 150 DR<br>0.5% 1,1-butylidene-4,4'-bis-(2-t-butyl-5-methylphenol) | 0.7 | " | 25% at 6E/2C<br>(33%) |

PEG-400 dilaurate = polyethylene oxide (400 mol. wt.) capped with lauric acid
Gantrez MO93 = poly(vinyl methyl ether) (GAF) $\overline{M}w$ = 18,000 estimated
Monamid 150 DR = coconut diethanolamide emulsifier
Lutanol M40 = poly(vinyl methyl ether) (BASF) $\overline{M}w$ = 62,000 estimated
PETP = pentaerythritol tetranelargonate
PVME = poly(vinyl methyl ether)
*filaments coated with 1% by weight of a conventional finish based on coconut oil unless otherwise stated
**cord construction = yarn denier/yarns twisted/plies twisted, tension in adhesive dip/latex dip

I claim:

1. A synthetic filament coated with 0.4 to 2% by weight of a lubricating finish composition comprising (1) 60–96% by weight of a lubricant oil,
(2) 1–6% by weight of a solid lubricant selected from the group consisting of metallic soaps, graphite, boron nitride, fumed silica, polyalkylene waxes and microcrystalline waxes,
(3) 1–15% by weight of a poly(vinyl alkyl ether) having 1–4 carbon atoms in the alkyl group and
(4) 0–30% by weight of an emulsifier.

2. The filament of claim 1 wherein the filament is composed of poly(p-phenylene terephthalamide).

3. The filament of claim 1 wherein the filament is poly(hexamethylene adipamide).

4. The filament of claim 1 wherein the filament is poly(ethylene terephthalate).

5. The filament of claim 1 wherein the lubricant oil is selected from the group consisting of liquid phthalic acid esters of 8–14 carbon alkanols and pentaerythritol completely esterified with fatty acids or mixtures of fatty acids having 8–10 carbon atoms.

6. The filament of claim 5 wherein the lubricant oil is selected from the group consisting of diundecyl phthalate and pentaerythritol tetrapelargonate.

7. The filament of claim 5 wherein the solid lubricant is selected from the group consisting of polyalkylene and microcrystalline waxes.

8. The filament of claim 5 wherein the finish composition contains 2–30% by weight of an emulsifier.

9. The filament of claim 5 wherein the poly(vinyl alkyl ether) is poly(vinyl methyl ether) having a weight average molecular weight of 10,000–70,000.

10. The filament of claim 9 wherein the finish composition contains 4–10% by weight of poly(vinyl methyl ether) having a weight average molecular weight of about 18,000.

11. The filament of claim 9 wherein the finish composition contains 2–6% by weight of poly(vinyl methyl ether) having a weight average molecular weight of about 62,000.

12. The filament of claim 5 wherein the solid lubricant is a metallic soap.

13. The filament of claim 12 wherein the metallic soap is magnesium stearate.

14. The filament of claim 12 wherein the metallic soap is lithium stearate.

15. A synthetic filament coated with 0.4 to 2% by weight of a lubricating finish composition comprising
(1) 60–96% by weight of a lubricant oil selected from the group consisting of diundecyl phthalate and pentaerythritol tetrapelargonate,
(2) 1–6% by weight of a solid lubricant selected from the group consisting of magnesium stearate, lithium stearate, polyalkylene waxes and microcrystalline waxes,
(3) 1–15% by weight of poly(vinyl methyl ether) having a weight average molecular weight of 10,000–70,000 and
(4) 2–30% by weight of an emulsifier.

16. The filament of claim 15 wherein the finish composition also contains an antioxidant.

17. The filament of claim 15 wherein the filament is composed of poly(p-phenylene terephthalamide).

18. Tire cord comprised of the filaments of claim 17.

19. A tire reinforced with the tire cord of claim 18.

* * * * *